US008657651B2

(12) United States Patent
Hofmann

(10) Patent No.: US 8,657,651 B2
(45) Date of Patent: Feb. 25, 2014

(54) APPARATUS FOR GRINDING A CONTINUOUSLY CAST WORKPIECE

(75) Inventor: Karl Robert Hofmann, Netphen (DE)

(73) Assignee: SMS Logistiksysteme GmbH, Netphen (DE)

( * ) Notice: Subject to any disclaimer, the term of this patent is extended or adjusted under 35 U.S.C. 154(b) by 167 days.

(21) Appl. No.: 13/402,570

(22) Filed: Feb. 22, 2012

(65) Prior Publication Data

US 2012/0258650 A1 Oct. 11, 2012

(30) Foreign Application Priority Data

Apr. 8, 2011 (EP) ..... 11002956

(51) Int. Cl.
*B24B 1/00* (2006.01)

(52) U.S. Cl.
USPC ..... 451/64; 451/190; 451/194; 451/365; 451/387; 451/405

(58) Field of Classification Search
USPC ..... 451/190, 194, 365, 387, 405, 388, 64; 414/732; 269/289 R, 903; 125/13.01, 125/451, 269
See application file for complete search history.

(56) References Cited

U.S. PATENT DOCUMENTS

| | | | | | |
|---|---|---|---|---|---|
| 324,641 | A | * | 8/1885 | Berry | 451/194 |
| 1,865,067 | A | * | 6/1932 | Warsow | 451/194 |
| 2,215,692 | A | * | 9/1940 | Fleming | 451/194 |
| 2,218,647 | A | * | 10/1940 | Kirkman | 451/194 |
| 5,056,267 | A | * | 10/1991 | Nicely et al. | 451/24 |
| 2011/0281505 | A1 | | 11/2011 | Hofmann | |
| 2012/0022681 | A1 | | 1/2012 | Schiller | |

* cited by examiner

*Primary Examiner* — George Nguyen
(74) *Attorney, Agent, or Firm* — Andrew Wilford

(57) ABSTRACT

An apparatus for grinding a continuously cast slab having a longitudinal axis and a rectangular cross-sectional shape with two opposite wide faces and two opposite narrow faces apparatus has a frame, two transversely spaced grinders carried on the frame, and a holder having two transversely spaced grippers engageable with the opposite faces of the slab in a vertical position with the wide faces of the slab vertical for grinding of the wide faces of the slab by the grinders and in a horizontal position offset by 90° to the vertical position with the wide faces of the slab horizontal for grinding of the narrow faces of the slab.

14 Claims, 11 Drawing Sheets

APPARATUS FOR GRINDING A CONTINUOUSLY CAST WORKPIECE

FIELD OF THE INVENTION

The invention relates to an apparatus for grinding a continuously cast workpiece, in particular a slab having a longitudinal axis and a rectangular cross-sectional shape with two wide faces lying opposite each other and two narrow faces lying opposite each other, the apparatus comprising at least one, preferably two grinding tools, that can grind two opposite faces of the continuously cast workpiece.

BACKGROUND OF THE INVENTION

An apparatus of this type is known from US 2011/1281505 and US 2012/0022681. Continuously cast workpieces, in particular slabs, after continuous casting are here subjected to a surface treatment by grinding so as to have a sufficient quality for the further processing of the product. When grinding slabs, the slabs are usually reciprocated longitudinally back and forth under a grinder. At the end of each reciprocation, the grinder is stepped transversely until the entire slab face is ground.

Handling of the slab is not without difficulty here. The grinder with its two grinding wheels normally grinds a vertical face of the slab or two opposite vertical faces. If the wide faces are to be ground first and then the narrow faces of the slab, the slab is to be moved accordingly into the required processing position.

OBJECT OF THE INVENTION

The object of the invention is to further develop an apparatus of the type mentioned at the outset such that it is possible in a simplified manner to move the slab into the required position and to hold it there in a stable manner during the grinding process.

SUMMARY OF THE INVENTION

An apparatus for grinding a continuously cast slab having a longitudinal axis and a rectangular cross-sectional shape with two opposite wide faces and two opposite narrow faces has according to the invention a frame, two transversely spaced grinders carried on the frame, and a holder having two transversely spaced grippers engageable with the opposite faces of the slab for shifting the slab between a vertical position with the wide faces of the slab vertical for grinding of the wide faces of the slab by the grinders and a horizontal position offset by 90° to the vertical position with the wide faces of the slab horizontal for grinding of the narrow faces of the slab.

Thus the holder that can hold the continuously cast workpiece in two different positions, and during the grinding process of two opposite faces holds it once in the vertical and once in the horizontal position. In this manner all four faces of a slab gripped in the holder can be processed by grinding without having to reposition it. A complex reclamping or shifting of the slab, which moreover takes additional time, as is absolutely necessary in the category-defining prior art, can thus be omitted.

The holder preferably has an upper beam and a lower beam that can be braced relative to each other in a direction perpendicular to the longitudinal axis in order to clamp the continuously cast workpiece between them. To brace the upper beam and the lower beam preferably at least one actuator, in particular a cylinder, is engaged between the upper beam and the lower beam.

Gripping elements, in particular gripping claws, can be provided on the upper beam and/or on the lower beam, which gripping elements are provided in particular on the upper beam or on the lower beam in a spring elastic manner. The slab can be held securely thereby.

Furthermore, pivoting gripping elements, in particular pivoted arms, can be provided on the upper beam or on the lower beam, in order to be able to clamp the continuously cast workpiece on both sides of the upper beam or of the lower beam. This is in particular advantageous when the slab is to be held or gripped in the horizontal position.

The lower beam can be pivotal about an axis extending parallel to the longitudinal axis. In this case it can be further provided that the upper beam is pivotal about the pivot axis. The upper beam and the lower beam are hereby preferably provided on or in an inner holder frame, wherein at least one actuator acts on the holder frame in order to pivot or rotate the inner holder frame together with the upper beam and the lower beam around a pivot axis extending parallel to the longitudinal axis of the beam.

Furthermore, a pivot motor can actively act on the holder frame in order to pivot or rotate the holder frame together with the upper beam and the lower beam about the pivot axis. This is advantageous particularly when the actuator has a neutral point at which it cannot exert any torque on the holder frame.

The holder is preferably provided on or in a outer movable frame that is can move longitudinally along a guide of the apparatus.

In the case of a slab oriented vertically for grinding, preferably the two opposite wide faces of the continuously cast workpiece are ground simultaneously by at least two grinding tools. The apparatus accordingly preferably has two grinders each with at least one grinding tool that are set up for the simultaneous processing of the two opposite faces of the continuously cast workpiece.

The wide faces of the continuously cast workpiece are usually at least double the width of the narrow faces, often even much more than double.

With the proposed embodiment of the apparatus it is possible to hold a slab in a simple and secure manner in order to grind the opposite narrow or wide faces. In particular it is hereby possible in a simple manner to hold or clamp the slab once in the vertical and once in the horizontal position in order to be able to grind all four faces.

BRIEF DESCRIPTION OF THE DRAWING

The above and other objects, features, and advantages will become more readily apparent from the following description, reference being made to the accompanying drawing in which.

DETAILED DESCRIPTION

Figure 2:
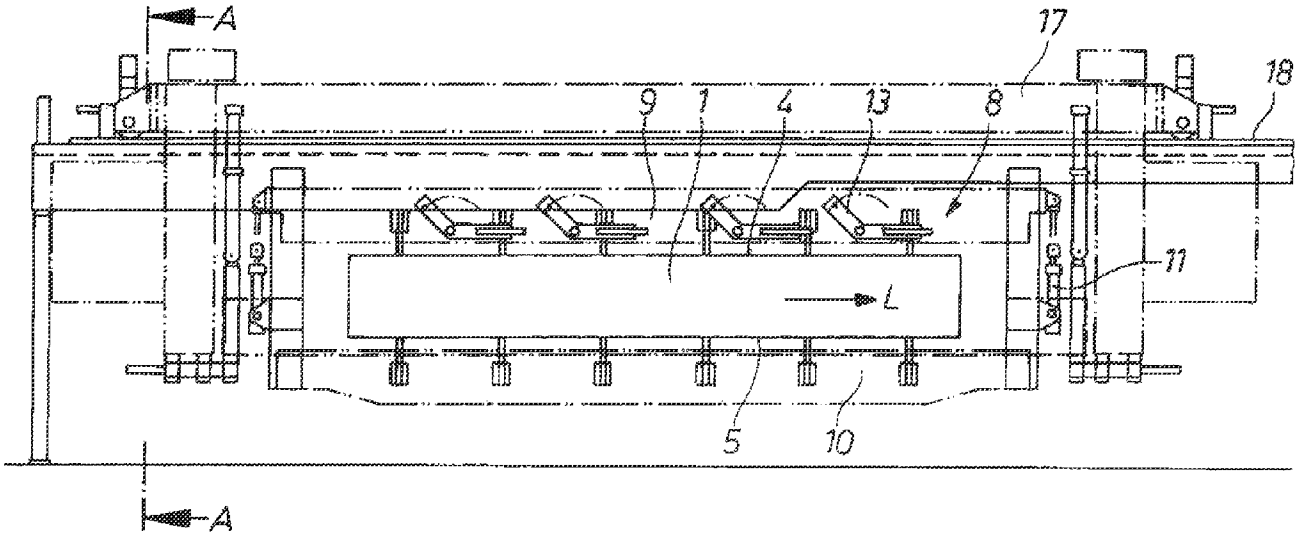
FIG. 2 is a side view of the apparatus for grinding.

An apparatus for grinding a slab 1 is shown in different views in FIGS. 1 through 5. The slab 1 has a rectangular cross section that can be seen in FIG. 1. It extends in FIG. 1 with its longitudinal axis L perpendicular to the drawing plane. The slab 1 accordingly has two long or wide faces 2 and 3 and two short or narrow faces 4 and 5. The wide faces 2 and 3 are at least double the width of the narrow faces 4 and 5, as a rule even very much wider.

The slab faces 2-5 must be processed by grinding in order ultimately to be able to produce a product with sufficient quality from the slab 1. To this end a grinder is provided that can be seen particularly clearly from FIGS. 4 and 5. The grinding tools are shown at 6 and 7 in FIGS. 4 and 5.

Figure 4:
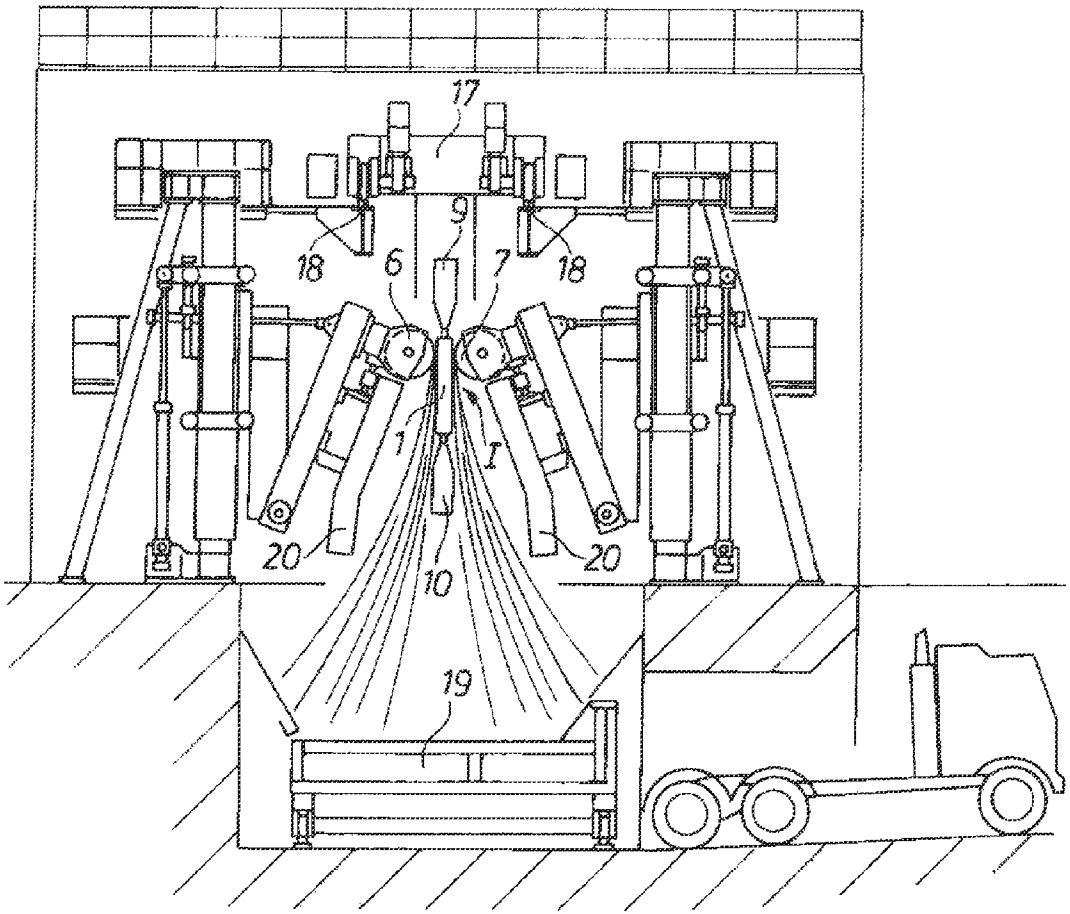
FIG. 4 is a section through the apparatus taken along line B-B of FIG. 3 during the grinding of the main faces, i.e. the wide faces of the slab.
Figure 5:
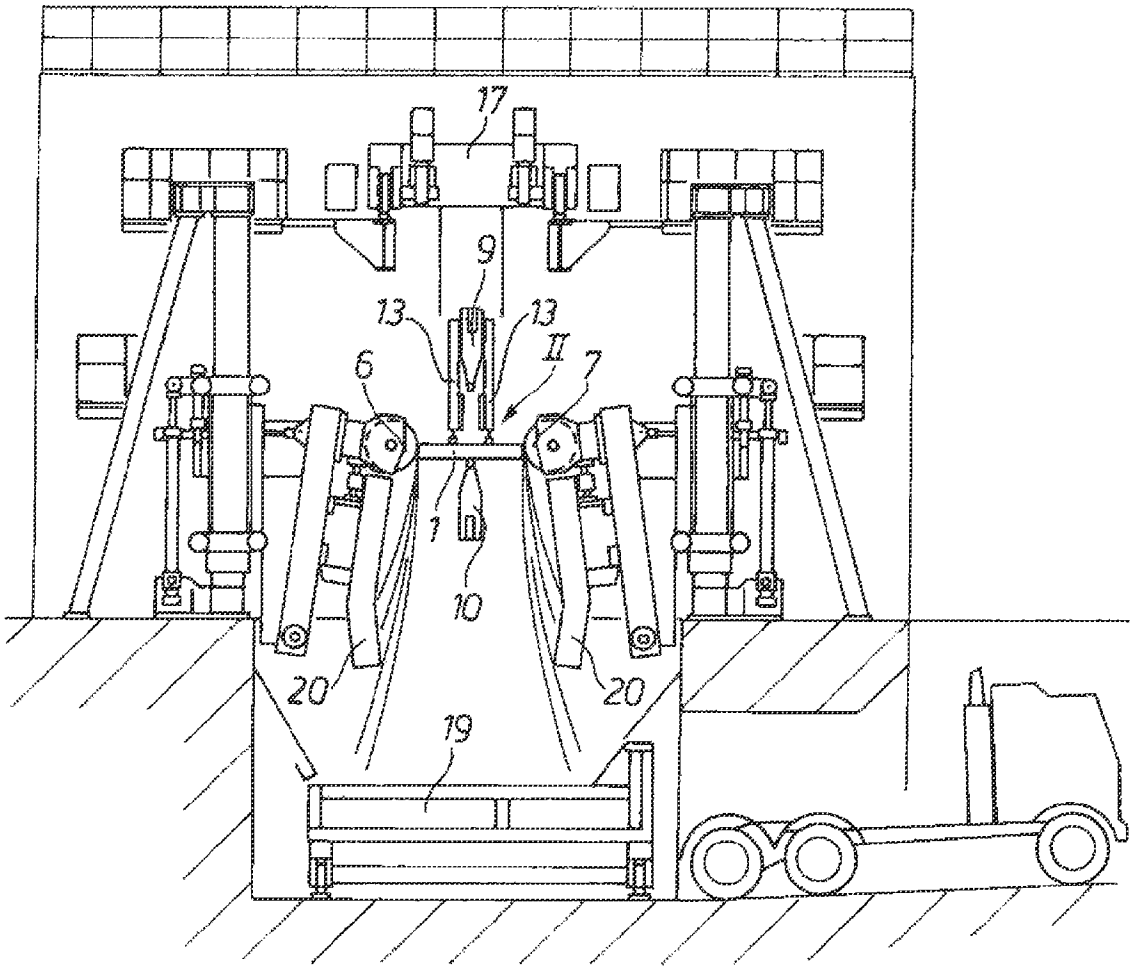
FIG. 5 is a section through the apparatus taken along line B-B of FIG. 3 during the grinding of the secondary faces, i.e. the narrow faces of the slab.

FIG. 4 shows that, for grinding the wide faces 2 and 3, the slab 1 must be held in a vertical position indicated at I. In contrast, FIG. 5 shows that the slab 1, in order to be able to grind the narrow faces 4 and 5, must be gripped in a horizontal position indicated at II.

A chip collection container 19 (FIGS. 4 and 5) can be positioned below the grinding tools 6 and 7. Grinding chips are guided into it by baffle plates 20.

Figure 6:
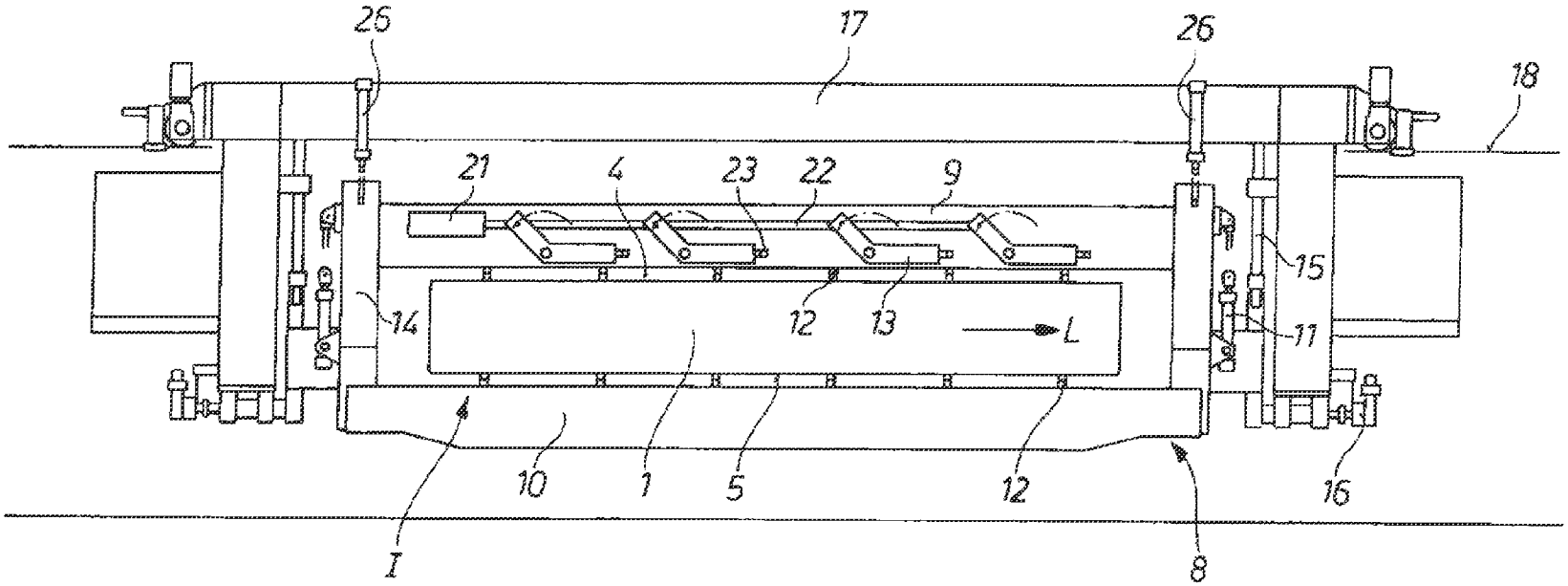
FIG. 6 is a side view of a holder for holding the slab with the slab gripped in a vertical position.
Figure 7:
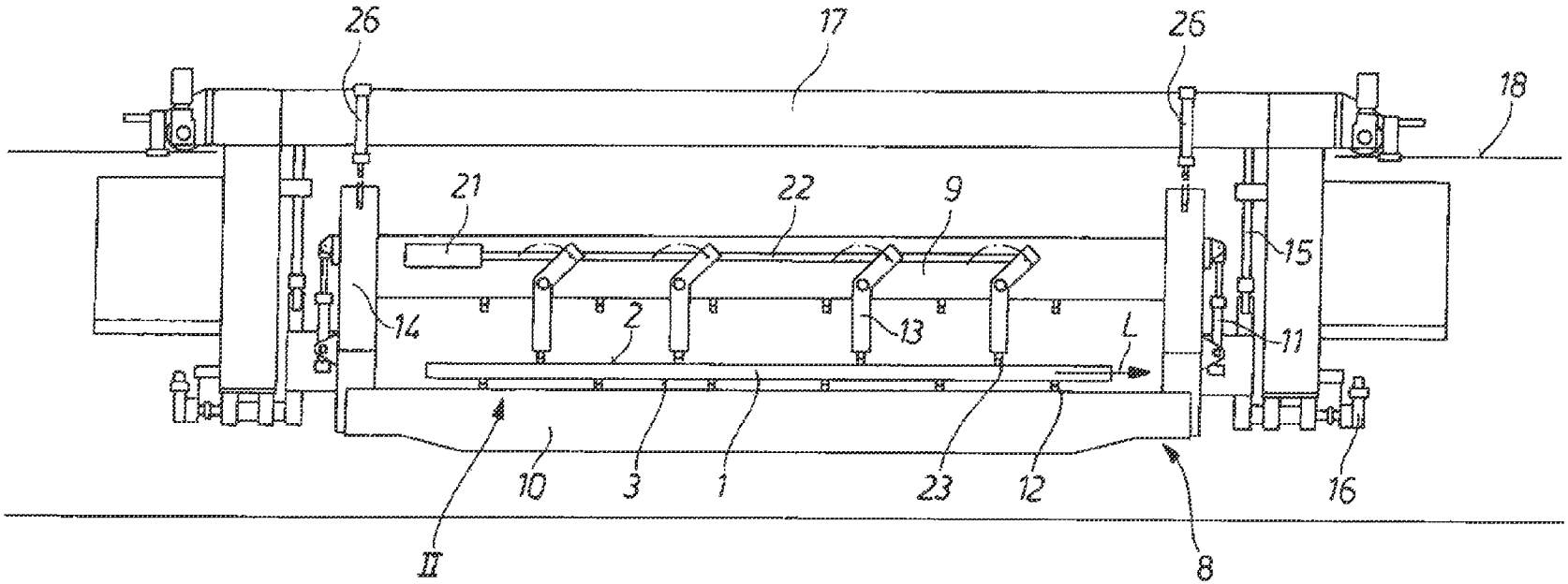
FIG. 7 shows the holder as in FIG. 6 with the slab gripped in a horizontal position.
Figure 8:
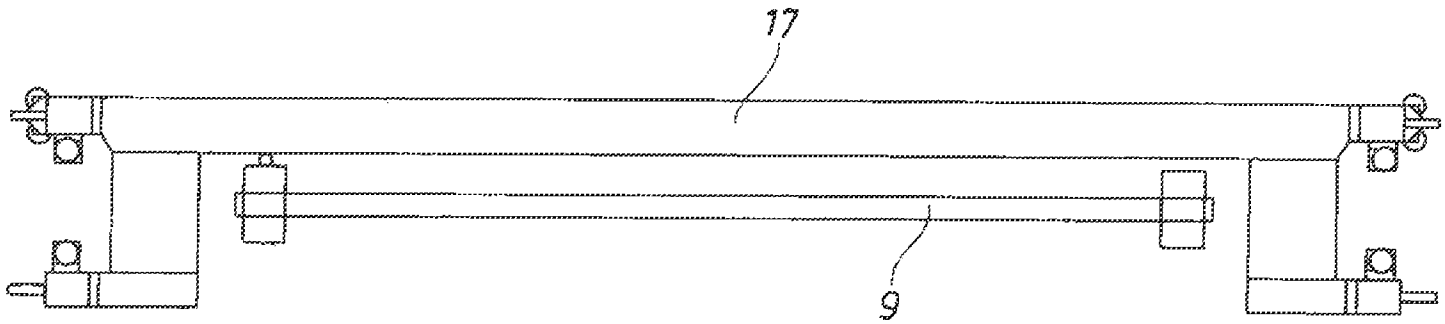
FIG. 8 shows the holder as in FIGS. 6 and 7 in plan view.

Details of a holder 8 that can hold the slab 1 in the desired position are discernible in FIGS. 6 through 8.

The holder 8 comprises an upper beam 9 and a lower beam 10. The two beams 9 and 10 can be moved relative to each other in a direction perpendicular to the longitudinal axis L of the slab 1 in order to clamp the slab 1 between them.

An actuator 11 in the form of a cylinder is provided for gripping the slab 1. Gripping elements or claws 12 are used that are provided on the upper beam 9 as well as on the lower beam 10. They can also be mounted via elastic or spring supports in order to be able to bear tightly against the slab 1 when clamping it.

If the slab 1 is gripped in the first position I, i.e. is vertically oriented as shown in FIG. 4, the gripping claws 12 of the upper beam 9 press from above down against the narrow edge 4 and the grippers 12 of the lower beam 10 press from below up against the narrow face 5 (see FIG. 1), so that the slab 1 is held with the wide faces 2 and 3 vertical and fully exposed so that the grinders 6 and 7 can surface-treat them.

For gripping the slab 1 in the second position II shown in FIG. 5 several, here four, gripping elements or arms 13 are pivoted on each of the sides of the upper beam 9 spaced apart along the axis L and pivotal about respective parallel axes perpendicular to the beam 9. As shown in FIGS. 6 and 7, these pivoted arms 13 can be pivoted via an actuator 21 that is connected to all of the pivoted arms 13 via a rod 22. The actuator 21 can be operated hydraulically or electrically.

In FIG. 6 the pivoted arms 13 can be seen in their out-of-the-way or passive position. FIG. 7 shows the arms 13 after having been pivoted by the actuator 21 into their active position projecting past the lower edge of the beam 9, i.e. the pivoted arms 13 press from above onto the upwardly directed wide face 2 of the slab 1. For a secure support, in turn gripping elements 23 in the form of gripping claws are provided at the end of the pivoted arms 13. Thus in this horizontal position II as clearly shown in FIG. 5 the slab 1 is gripped from above on the upwardly directed face 2 along two transversely spaced but longitudinally extending rows of points by the elements 23 of the arms 13 and from below on the downwardly directed face 3 at a central longitudinally extending row of points by the elements 12 of the lower beam 10. The upper row of gripping points flank the center of the upper face 4 and the lower row of gripping points lie on the center of the lower face 5 so that tipping about the longitudinal axis L is prevented.

Figure 1:
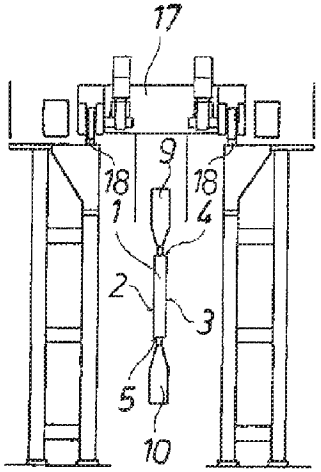
FIG. 1 is a section through an apparatus for grinding a continuously cast workpiece in the form of a slab taken along line A-A of FIG. 2.
Figure 3:
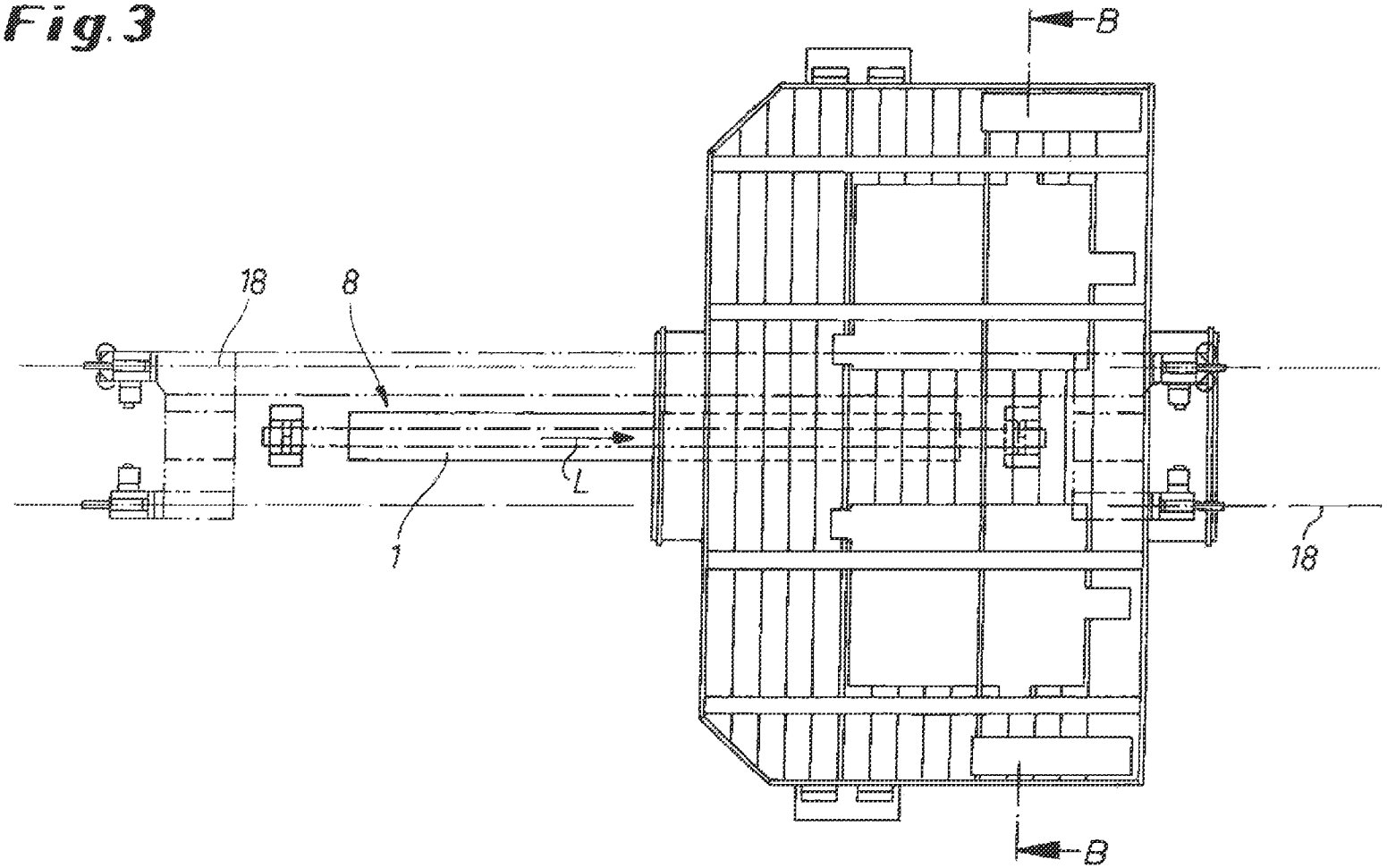
FIG. 3 is a top view of the apparatus for grinding.

It should also be noted that the entire holder 8 formed by the upper beam 9 and the lower beam 10 as well as an inner holder frame 14 carrying these two beams 9 and 10 is provided in a outer movable frame 17 that as shown in FIGS. 1 through 3 can be moved on a guide 18 parallel to the longitudinal axis L. Thus the workpiece slab 1 can be stroked longitudinally back and forth relative to the grinders 6 and 7.

The holder 8 can be locked in the processing position relative to the movable frame 17 by cylinders 26. This is to be provided in any case when the holder 8 is pivotal on the outer movable frame 17, see below. The locking cylinder 26 can operate hydraulically, pneumatically or electrically.

Figure 9:
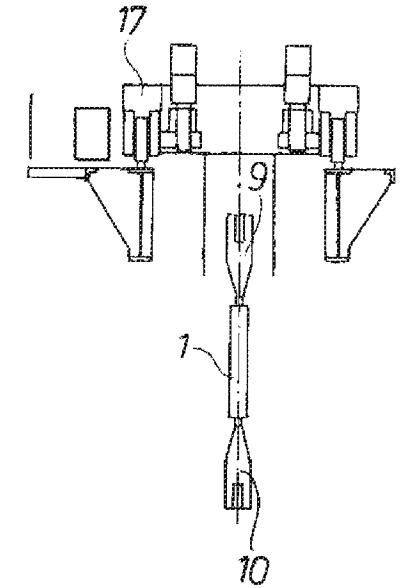
FIG. 9 shows the slab as it is being picked up into the apparatus in vertical position for grinding the main faces of the slab, seen longitudinally of the slab.

Picking-up of the slab 1 into the apparatus with a vertically oriented slab 1 is shown in FIG. 9. The slab 1 can be moved vertically through an opening in the movable frame 17. The movable frame 17 and the frame 14 of the holder 8 can be fixed together, i.e. a pivot between the holder frame 14 and the outer movable frame 17 is not necessary with operation according to this solution.

Figure 10:
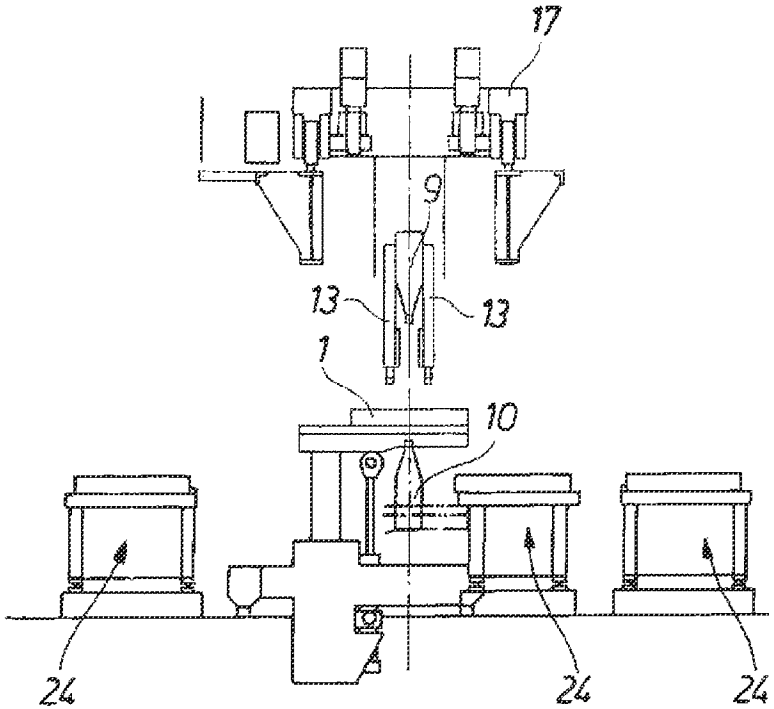
FIG. 10 shows the slab being picked up into the apparatus with the slab in horizontal position for grinding the secondary faces of the slab, seen longitudinally of the slab.
Figure 11:
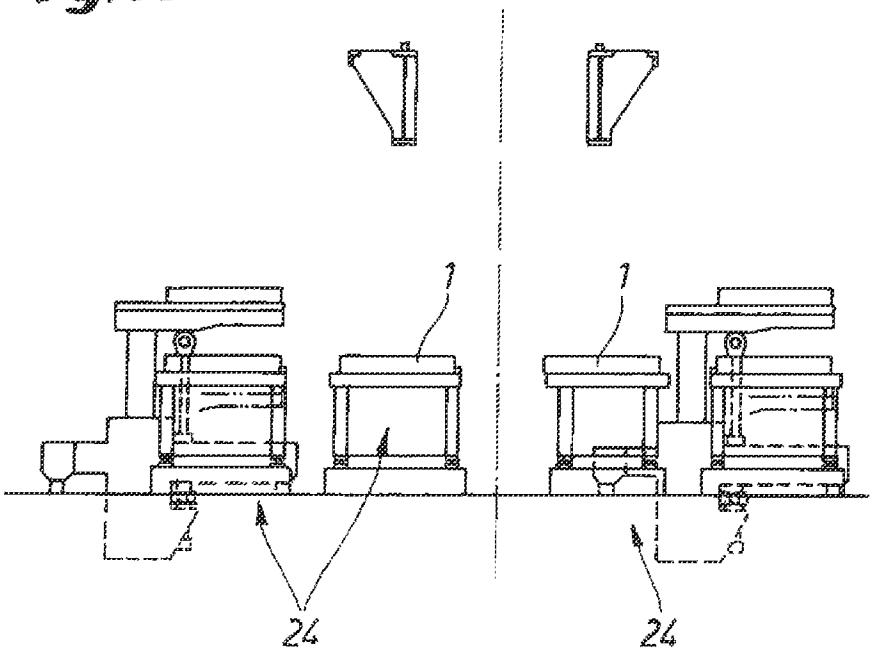
FIG. 11 is a diagrammatic view of a transverse transport of slabs before being picked up the holder, seen longitudinally of the slab.

Loading of the holder 8 for grinding the narrow faces 4 and 5 of the slab 1 is shown in FIG. 10. The slab 1 can be brought into the required position by suitable rolling tables 24 in order then to be grasped and gripped by the pivoted arms 13 of the upper beam 9 from above and the grippers 12 of the lower beam 10 from below. FIG. 11 shows the transverse transport of the slabs 1 by tables 24 that are displaceable transversely of the longitudinal axis L.

Figure 12:
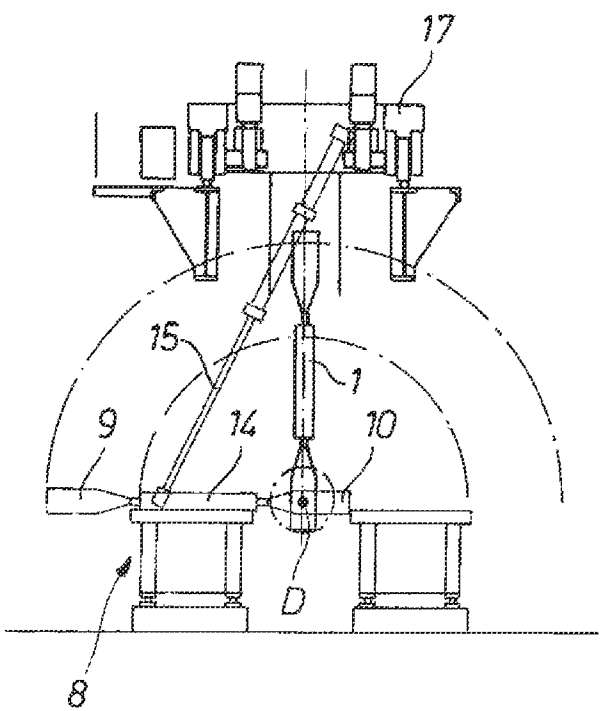
FIG. 12 shows the slab being picked up into the apparatus in horizontal position, seen longitudinally of the slab.

A further picking-up of the horizontally oriented slab 1 into the apparatus can be seen in FIG. 12. Here the slab 1 is gripped between the upper beam 9 and the lower beam 10 in the cited manner. In this illustrated embodiment, however, the inner holder frame 14 that supports the upper beam 9 and the lower beam 10 can be rotated or pivoted about an axis D extending parallel to the longitudinal axis L and vertically level with the center of the slab 1 that is lying flat, that is horizontally, on one of the tables 24.

For pivoting from the position in which the slab 1 is oriented horizontally into the position in which it is oriented vertically, an actuator 15 is provided that acts on the holder frame 14 and pivots the holder 8 about the pivot axis D relative to the movable frame 17. FIGS. 6 and 7 show a pivot motor 16 also pivoting the frame 14 about the pivot axis D.

Accordingly, in this case the slab 1 can be moved into the horizontal position or picked up from a support (table 24) through an opening in the movable frame 17. Pivoting of the holder 8 and its frame 14 relative to the movable frame 17 makes it possible to subsequently tip the slab 1 from the horizontal into the vertical position.

Figure 13:
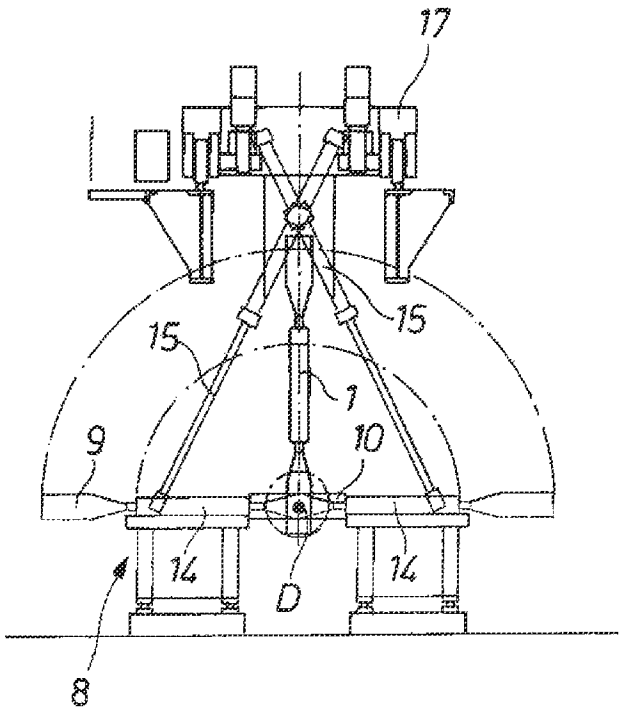
FIG. 13 shows another position during picking up of the slab into the apparatus in horizontal position, seen longitudinally of the slab.

FIG. 13 shows the possibility of picking up the slab 1 in horizontal positions optionally from the left or the right of the lower beam 10.

Figure 15:
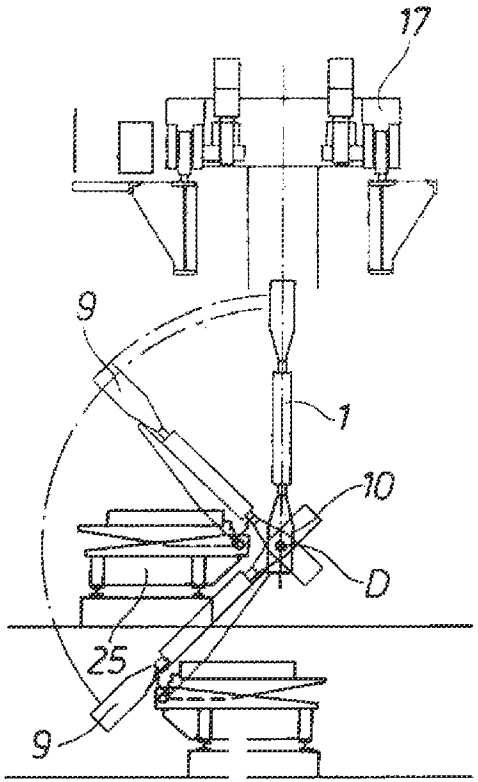
FIG. 15 shows another picking up of the slab into the apparatus with obliquely oriented slab, seen longitudinally of the slab.
Figure 14:
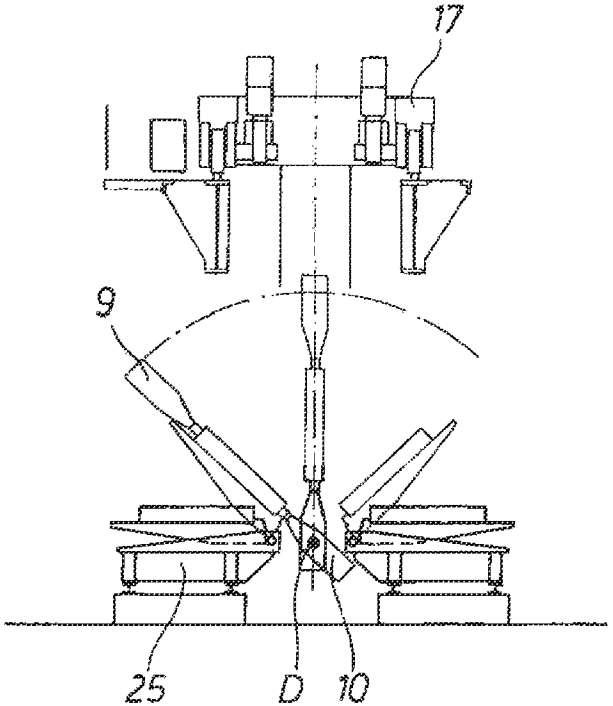
FIG. 14 shows picking up of the slab into the apparatus with an obliquely oriented slab, seen longitudinally of the slab.

This principle is embodied somewhat more broadly in the solutions according to FIGS. 14 and 15. According to these figures, the slab 1 is pivoted into an intermediate position by a tilting table 25, this intermediate position being between the horizontal and the vertical orientation. The holder 8 takes the slab 1 from this intermediate position and consequently needs only to pivot the slab 1 into the vertical alignment through an angle of less than 90°, here 45°. This saves time during positioning of the slab in the grinder.

FIG. 15 shows that the slab handling can also be carried out in that the slab 1 is picked up below the grinding plane. The holder 8 is then pivoted into the vertical position through an angle of more than 90°.

A further variant is also possible: the tilting table 25 can bring the slab 1 from the horizontal orientation completely into the vertical orientation. This means that pivoting of the inner holder frame 14 can be omitted entirely.

The movable frame 17 preferably has only one side longitudinal beam so that the holder 8 can be altogether pivoted in laterally from the other side. The movable frame 17 rides on four wheels and has two drives and guide rollers.

I claim:

1. An apparatus for grinding a continuously cast slab having a longitudinal axis and a rectangular cross-sectional shape with two opposite wide faces and two opposite narrow faces, the apparatus comprising:

a frame;

two transversely spaced grinders carried on the frame; and a holder having two transversely spaced grippers adapted to hold the slab and shiftable between a vertical position with the opposite wide faces of the slab vertical for grinding of the wide faces of the slab by the grinders and a horizontal position offset by 90° to the vertical position with the wide faces of the slab horizontal for grinding of the narrow faces of the slab.

2. The grinding apparatus defined in claim 1, wherein the holder has a longitudinally extending upper beam carrying one of the grippers and a longitudinally extending lower beam carrying the other of the grippers, at least one of the beams being movable transversely toward and away from the other of the beams.

3. The grinding apparatus defined in claim 1, further comprising:

actuator means engaged between the frame and the one beam for shifting the beams transversely toward and away from each other.

4. The grinding apparatus defined in claim 3 wherein each of the beams is provided with at least one longitudinally extending row of the grippers.

5. The grinding apparatus defined in claim 4 wherein one of the beams is provided with a center row of the grippers fixed on the one beam and with two outer longitudinally extending rows of the gripper elements flanking the center row and shiftable between a retracted position transversely outward of the center-row grippers and an advanced position transversely inward of the center-row grippers.

6. The grinding apparatus defined in claim 4 wherein the one beam is provided along each longitudinal side with a row of pivotal arms each carrying a respective one of the outer-row grippers.

7. The grinding apparatus defined in claim 2 wherein the lower beam is pivotal about an axis parallel to a longitudinal pivot axis of the beam.

8. The grinding apparatus defined in claim 7 wherein the upper beam is pivotal about the pivot axis of the lower beam.

9. The grinding apparatus defined in claim 8 wherein the frame includes an inner frame carrying the upper and lower beam and an outer frame on which the inner frame is pivotal about the pivot axis, the apparatus further comprising an actuator engaged between the outer frame and the inner frame for pivoting the inner frame about the pivot axis.

10. The grinding apparatus defined in claim 9 wherein the actuator is a motor carried on the outer frame.

11. The grinding apparatus defined in claim 9, further comprising a guide along which the outer frame is movable longitudinally.

12. An apparatus for grinding a continuously cast slab having a longitudinal axis and a rectangular cross-sectional shape with two opposite wide faces and two opposite narrow faces, the apparatus comprising:

an outer frame;

an inner frame pivotal about a horizontal and longitudinally extending axis on the outer frame;

two transversely spaced grinders;

a longitudinally extending upper holder beam in the inner frame carrying a respective center row of grippers;

a longitudinally extending lower holder beam in the inner frame carrying a respective center row of grippers;

two outer rows of grippers on one of the holder beams flanking the respective center row of grippers, the outer rows of grippers being shiftable on the one holder beam between a retracted position transversely outward of the respective center row of grippers and an advanced position transversely inward of the respective center row of grippers;

a first actuator for shifting the beams transversely toward and away from each other;

a second actuator for transversely shifting the holder beams on the inner frame transversely toward and away from each other and thereby gripping the slab in either of two 90° offset positions with the two outer rows of grippers in the advanced position for gripping the slab by the wide faces and with the two outer rows of grippers in the retracted position for gripping the slab by the narrow faces.

13. The apparatus defined in claim 12, wherein the one beam is provided on each side with a plurality of arms each carrying a respective one of the outer-row grippers.

14. The apparatus defined in claim 13, further comprising a third actuator for shifting the outer rows of grippers on the one beam between the advanced and retracted positions.

* * * * *